US007374697B2

(12) United States Patent
Kelley et al.

(10) Patent No.: US 7,374,697 B2
(45) Date of Patent: May 20, 2008

(54) COLOR-SAFE FABRIC WRINKLE REMOVING AND REFRESHING COMPOSITION

(76) Inventors: Thomas Kelley, 2204 W. Monterey Ave., Mesa, AZ (US) 85202; Daniel Gwilliam, 2212 W. Monterey Ave., Mesa, AZ (US) 85202

( * ) Notice: Subject to any disclaimer, the term of this patent is extended or adjusted under 35 U.S.C. 154(b) by 1001 days.

(21) Appl. No.: 10/609,351

(22) Filed: Jun. 30, 2003

(65) Prior Publication Data

US 2004/0004206 A1 Jan. 8, 2004

Related U.S. Application Data

(63) Continuation-in-part of application No. 09/949,468, filed on Sep. 10, 2001, now abandoned.

(60) Provisional application No. 60/295,477, filed on Jun. 4, 2001, provisional application No. 60/266,502, filed on Feb. 6, 2001, provisional application No. 60/237,680, filed on Oct. 5, 2000, provisional application No. 60/233,673, filed on Sep. 19, 2000.

(51) Int. Cl.

| | |
|---|---|
| ***D06M 13/144*** | (2006.01) |
| ***D06M 13/00*** | (2006.01) |
| *D06M 23/00* | (2006.01) |
| *D06M 23/10* | (2006.01) |

(52) U.S. Cl. ..... 252/8.91; 510/513

(58) Field of Classification Search ..... 252/8.91; 510/513

See application file for complete search history.

(56) References Cited

U.S. PATENT DOCUMENTS

| | | | | |
|---|---|---|---|---|
| 3,600,325 | A * | 8/1971 | Kaufman et al. | 252/8.91 |
| 3,674,688 | A * | 7/1972 | Schwartz et al. | 252/8.91 |
| 4,661,268 | A * | 4/1987 | Jacobson et al. | 252/8.91 |
| 4,806,254 | A * | 2/1989 | Church | 510/513 |
| 5,100,566 | A * | 3/1992 | Agbomeirele et al. | 252/8.91 |
| 5,573,695 | A * | 11/1996 | Targosz | 252/8.91 |
| 6,001,343 | A * | 12/1999 | Trinh et al. | 424/76.4 |
| 6,495,058 | B1 * | 12/2002 | Frankenbach et al. | 252/8.91 |
| 6,524,494 | B2 * | 2/2003 | Hart et al. | 252/8.91 |

FOREIGN PATENT DOCUMENTS

| | | | |
|---|---|---|---|
| JP | 1-292184 | A * | 11/1989 |
| JP | 1-292185 | A * | 11/1989 |

* cited by examiner

*Primary Examiner*—Anthony J Green

(57) ABSTRACT

Composition spray applied on fabrics to de-wrinkle and refresh while protecting colors which leaves no discernable residue. Quality water, one or more alcohol(s) and one or more surfactant(s) penetrate the fabric weave. One or more acids lower pH to stabilize sensitive dyes, thus ensuring color-safeness. Alcohols hasten drying and fragrances mask alcohol odor and help consumers identify the product. Mechanical action(s) by the user enhances wrinkle removal or imparts shape. Optional malodor-eliminating compounds keep fabrics fresh longer, or refresh malodorous garments. Optional specific quaternary ammonium compound reduces static cling but does not significantly increase residues. The composition de-wrinkles commercial fabrics, and clothing from casual to fine, spray applied using a pre-compression sprayer. The composition is environmentally friendly, safe for use on all types of fabrics, and safe for use at home or commercially.

8 Claims, No Drawings

COLOR-SAFE FABRIC WRINKLE REMOVING AND REFRESHING COMPOSITION

II. CROSS-REFERENCE TO RELATED APPLICATIONS

This application claims the benefit of U.S. Provisional Application Nos. 60/233,673 filed Sep. 19, 2000, 60/237,680 filed Oct. 5, 2000, 60/266,502 filed Feb. 6, 2001, and 60/295,477 filed Jun. 4, 2001; and, is a continuation-in-part of U.S. Non-Provisional application Ser. No. 09/949,468 filed Sep. 10, 2001 and now abandoned.

III. STATEMENT REGARDING FEDERALLY SPONSORED RESEARCH OR DEVELOPMENT

Not Applicable.

IV. REFERENCE TO A MICROFICHE APPENDIX

Not Applicable.

V. BACKGROUND OF THE INVENTION (A) Field of the Invention

This invention is a composition of matter. It is packages of such composition or other articles of manufacture which include such composition, or apparatus for use in or peculiar to such method or process. This invention is also a fluid treatment and chemical modification of textiles and fibers, more specifically, a composition for enhancing the appearance of consumer textile goods. The composition is spray applied on fabrics to relax and reduce wrinkles in casual to fine clothing, fabrics, or textiles while ensuring color-safeness. This invention is also a fluid treatment and chemical modification of fabrics, commercial textiles and woven fibers, more specifically, a composition for enhancing the appearance of, and ease of manufacturing, processing, handling, maintaining or installing fabrics, commercial fabrics and textiles and woven fibers and protects against sensitive commercial, natural, native, or vintage dyes bleeding. It is sprayed or otherwise applied on textiles, fabrics or other woven industrial/commercial complexes to relax and reduce wrinkles while protecting against dye bleeding.

The present composition is color-safe, fast drying, environmentally friendly and safe for use on clothing and in the home. The composition may be spray applied, applied by pressurized aerosol spray canister, or by any other acceptable method. Preferably, a commercially available pre-compression sprayer with multiple volume-per-stroke settings is used to deliver a fine atomized mist of the composition. Commercial fabrics are de-wrinkled by delivering the composition via pressurized aerosol canister, atomizing sprayer, pre-compression sprayer or by any other acceptable method. Adding an optional malodor eliminating compound keeps fabrics fresh longer and/or refreshes malodorous garments by eliminating malodorous compounds. Adding a specific optional quaternary ammonium compound to the composition helps to reduce static cling without imparting a tacky residue.

Wrinkle relaxing and reducing compositions are well established in the art. However, the prior art has proved to be less than satisfactory in meeting its objective of relaxing and reducing wrinkles in fabrics, including fine fabrics such as silk. The prior art has not met its objective of the development of a wrinkle reducing and relaxing composition that works effectively to de-wrinkle, that does not leave a significant residue and which dries quickly—all at "household speeds."

(B) Description of the Related Art

Schwartz et al, U.S. Pat. No. 3,674,688, established a compound and process by combining alcohol and water with a cationic surfactant, preferably a quaternary ammonium compound. This composition is to be spray applied and the fabric manipulated to remove wrinkles. Thereafter, the composition is expected to take fifteen to sixty minutes to dry. Wrinkle relaxing reducing compositions with extended drying times are inconvenient and ineffective for use as a laundry aid. Targoz, U.S. Pat. No. 5,573,695, noted correctly, ". . . the portions of a garment wetted by the Schwartz et al composition mars the appearance of the garment with excessive wetting having the potential for causing shrinkage . . . ." Extended drying times may cause shrinkage, increase the likelihood of fabric distortion, cause fugitive dye bleeding, create an environment for spotting or rings, attract dust and dirt, foster cellulosic browning and create the circumstances whereby newly introduced or existing dust or dirt dissolves into the fabric, soiling the otherwise freshly laundered fabric. For the same reasons, compositions with extended drying times are not practical when used to de-wrinkle commercial fabrics.

Jacobson et al, U.S. Pat. No. 4,661,268, formulated a composition wherein a water and alcohol solution is enhanced by the presence of at least two or three surfactants: a silicone-glycol copolymer surfactant, and/or a flouronated alkyl ester surfactant either or both of which are to be combined with a quaternary ammonium salt surfactant. The Jacobson composition is to be spray applied in a fine mist and the fabric is then manually set and held until dry. Animal-based surfactants prove disadvantageous in the adequate lubrication of fibers and elimination of negative charge, particularly in the treatment of fine fabrics such as silk. In addition, both animal-based surfactants and heretofore all quaternary ammonium salt surfactants are semi-volatile and dry leaving a tacky residue. A tacky residue is unacceptable to the consumer. It fosters staining and enhances prospects for soiling. As such, the Jacobson composition is unsatisfactory for use as a home laundry aid or in commercial settings.

Agbomeirele et al, U.S. Pat. No. 5,100,566, formulated a water and alcohol solution having the addition of anionic siliconates applied to fabrics to reduce wrinkles. This composition requires an extended drying time. Silicone-based compositions have not found satisfactory use with fine fabrics such as silks." Silicone-based compositions also leave objectionable residues. Cellulosic browning occurs when saturated fibers release soluble lignin, a natural dyestuff. Lignin moves to and concentrates at the point of evaporation, resulting in stains and/or ring-like discoloration stains. And, fine organic fabrics such as silks suffer by over-saturation as any cellulosic fiber is subject to cellulosic browning when over-saturated. Therefore, the Agbomeirele et al composition would require extensive drying time and also increase the potential for staining.

In Kaufman et al, U.S. Pat. No. 3,600,325, an aerosol spray composition of alcohols and water is generally found to be less than effective for two reasons: 1) again, the purported need for large quantities of the composition to relax wrinkles; and, 2) again, extended drying times.

Church, U.S. Pat. No. 4,806,254, used large quantities of alcohol, glycerine and a nonionic surfactant in a composition which was ultimately found to need extensive drying time and to be less than useful on fine fabrics. However, glycerine extends drying times and may likely impart an objectionable residue on fabrics.

Targoz, in U.S. Pat. No. 5,573,695, relates the state of the art up to the year 1996. He states that, "... a need still exists in the art for effective, fast drying compositions of matter which quickly and readily remove wrinkles from textile fabrics and the like without leaving residues thereon." Targoz' solution was the development of a high purity de-ionized water and alcohol mixture containing a vegetable oil based cationic quaternary ammonium surfactant and a second surfactant, spray applied on fabrics in a fine mist. Although Targoz advanced the art, his composition ultimately missed his goal. While the small quantity of surfactant used is effective relative to the surfactant's ability to enhance wetting, the composition does not contain enough surfactant to eliminate significant static cling. To effectively eliminate static cling a garment needs to be comparatively saturated with surfactant. The amount of the cationic surfactant he proposes cannot achieve the static free state he promises. Increasing the amount of surfactant brings the negative implications of additional, noticeable tacky residues. Residues in these quantities will tend to increase the likelihood of premature soiling. More importantly, the Targoz composition has a pH that is at best neutral or slightly basic. The Targoz composition has a high enough pH that sensitive dyes may bleed and run, ruining fabrics, especially the fine fabrics such as silks that Targoz claims to be able to safely de-wrinkle. Neutral pH may not promote fugitive dye bleeding, however it would not prevent it in sensitive fabrics. Raising pH at all past neutral is a very definite danger insofar as fugitive dye bleeding is concerned. Buffered to an effective level to ensure color-safeness, the present composition brings forth a novel and practical solution to this problem. The present composition will safely de-wrinkle without dyes bleeding.

Trinh et al, in U.S. Pat. No. 6,001,343, relates to a stable, aqueous odor-absorbing and wrinkle controlling composition of uncomplexed cyclodextrin and at least one of a cyclodextrin compatible surfactant; cyclodextrin compatible antimicrobial active; and, mixtures thereof. The compositions stated primary purpose is controlling malodors. Its secondary purpose is controlling wrinkles. Comparative testing under identical conditions of the Trinh et al composition and the present composition clearly demonstrates the greater effectiveness of the present invention. Side-by-side tests conducted in industry laboratories demonstrated that the present composition more effectively relaxed and reduced wrinkles than the Trinh et al composition, wetted-out fabrics faster, dried faster and produced a finer, more consistent atomized spray. The Trinh et al composition also leaves a formidable residue on fabrics. The residue seems to be the malodor constituent of the "two-part" composition. To demonstrate the difference in amounts of residue between the two compositions, the authors placed 15 ml each of the present composition and the Trinh et al composition onto separate glass plates and allowed them to dry at room temperature. While residue of the present composition was barely discernable to the naked eye, the Trinh et al composition significantly clouded the glass plate to the point it became translucent and nearly opaque. The Trinh et al composition evaporated to deposit a thick, waxy residue on the otherwise transparent plate. Contrary to their claim(s), the Trinh et al composition does leave a heavy, waxy residue. The Trinh et al waxy residue is so present that one could imagine a build up over time, for example over-spray in the laundry room. This over-spray residue would be very unsightly and pose a slip hazard. The waxy residue will attract soils to fabrics at an accelerated rate. Importantly, the present composition evaporates and leaves no dicsernable residue.

VI. BRIEF SUMMARY OF THE INVENTION

This invention provides compositions of matter and processes for the application and use of such compositions that impart color-safeness, wrinkle removal and are fast drying, to be applied on casual to fine clothing and fabrics. Designed to mimic the tremendous de-wrinkling effect of live steam, the composition is akin to a "shot of cold steam." The composition is color safe, which is a novel and practical improvement in the art. The composition also de-odorizes fabrics or keeps fabrics fresh, longer, without noticeably increasing residues, which is practical and novel. It represents the most economical application of active agents in that the composition is uniformly applied in an almost microscopic mist. The user applies micron and sub-micron sized particles via a pump or trigger pre-compression sprayer, or any other acceptable method, and therefore one may apply very small quantities to effectively de-wrinkle. The present composition leaves almost no discernable residue. The fragrance masks the chemical smell of the alcohol or alcohols and it does not linger to interfere with perfumes or colognes. The fragrance also helps the consumer identify and recognize the composition. The thoroughness of the application on such a microscopic but effective scale virtually eliminates residue, and ensures that the fabric dries quickly. In contrast, the prior art used gross chemical application.

The user may effectively spot treat localized wrinkles, or impart shape by hand stretching or forming the fabric. Optional malodor eliminating compounds keep fabrics fresh, longer, or refresh malodorous garments. Adding a specific optional quaternary ammonium compound to the composition helps reduce static cling without imparting a tacky residue. The mechanical action of gently shaking the garment while on a clothes hanger or by the users "free hand" brushing against the garment soon after application of the composition further enhances wrinkle relaxation or reduction, especially with stubborn wrinkles or heavier fabrics. The mechanical action of hand forming a garment or fabric just after application of the composition allows for the formation of creases where desired.

Accordingly, it is one object of the invention to provide compositions of matter and processes and uses of such compositions for the chemical treatment of fibers, fabrics, woven commercial complexes, textiles and such to de-wrinkle and de-odorize. The effect of the preferred embodiment is to de-wrinkle better than anything the art has recognized, and dry faster. It is another objective that the present invention accomplish de-wrinkling without concerns about fugitive, natural, native, vintage, or other sensitive dyes bleeding or natural fibers experiencing cellulosic browning. This is accomplished by lowering the pH of the composition to a level that prohibits such destructive activity. Further objects and distinct advantages will become apparent from the following detailed description of the invention.

VII. BRIEF DESCRIPTION OF THE SEVERAL VIEWS OF THE DRAWING

Not Applicable.

VIII. DETAILED DESCRIPTION OF THE INVENTION

Wrinkle relaxing and reducing compositions are well established in the art. However, past compositions proved to be less than satisfactory in meeting the objective of quickly relaxing fibers to remove wrinkles from fabrics and no prior art maintained dye stability, especially on fine fabrics such as silk or fabrics dyed with natural, native, or vintage dyes. Soaking or saturating fabrics is not practical. A composition that leaves residue is not acceptable. The prior art fell short of providing a safe, color-safe, fast drying, environmentally friendly, wrinkle relaxing and reducing composition in a commercial setting and as a practical laundry aid. Beginning a new century, a new millennium, home, school and workplace fashions have changed. Starch and formal pressed, formal wear is no longer the norm. Causal to fine apparel is now accepted for all but the most formal occasions.

The present compositions are fast drying, readily biodegradable, and safe for use on clothing and in the home. The compositions may be pump or trigger spray applied, applied via pre-compression sprayer, pressurized aerosol spray canister, or by any other acceptable spray method.

The prior art seems confused in that the prior art often describes alcohols, silicones, surfactants and other ingredients as fiber lubricants and sometimes describes water as merely the carrier for these active chemicals. Although novel, this invention specifically recognizes that water plays an important role in relaxing and reducing wrinkles, and that it always has. Steaming fabric is the best way to achieve wrinkle reduction and relaxation. In the steaming process, water vapor penetrates the fabric weave to swell and relax fibers into their original relaxed state. The present invention attempts to mimic the de-wrinkling effect of steam by facilitating the penetration of extremely fine particles of the composition sprayed to swell and re-align fibers to their original relaxed configuration/orientation.

The preferred compositions use process quality softened, filtered water conditioned to remove hard water deposits, namely calcium and magnesium carbonates (hereinafter referred to as "process quality softened, filtered" water). The amount of process quality softened, filtered water in the composition may range from 82 to 94 percent by volume.

The present composition is introduced to the garment, fabric and/or commercial fibrous fabric weave by a very fine mist spray, produced by many acceptable means, but preferably from a pre-compression pump or trigger sprayer. A pre-compression sprayer sprays a uniform, fine vapor-like mist without drips, spitting or non-uniform droplets which heretofore may have caused spots or discoloration on fabrics, especially fine fabrics. Pre-compression sprayers deliver a uniform mist with droplet particle sizes in the range of several microns to sub-micron sizes. The smaller the droplet, the greater likelihood of effective delivery of the present composition without waste, spotting or local oversaturation. The smaller the droplet the more likely it is that the present composition de-wrinkles like steam. The ideal pre-compression sprayer has multiple volume-per-stroke settings providing variation to the amount of the composition being applied, and sprays on average one ml of liquid. This, preferred, regulated, pre-compression sprayer would have settings for fine fabrics, casual wear, heavy fabrics, and off. The composition is spray applied to garments from approximately eight to twenty four inches.

Prior compositions would have likely been poorly applied either by aerosol cans which are no longer accepted delivery mechanisms or by spray heads that either spit at low trigger pressures or at the end of some or all of the trigger strokes. Spitting the compositions of the prior art likely caused local over-saturation, spotting and possibly local discoloration, especially with fine fabrics, and sensitive, natural, native or vintage dyes.

Tests of the Trinh et al composition delivery mechanism shows that it spits. Spitting may cause local over-saturation and result in dye bleeding. Spitting can create a discolored spot that may ruin the fabric or garment. While Targoz used a pre-compression sprayer, his composition was not color-safe as it is neutral pH or even slightly basic. The preferred pump or trigger pre-compression sprayer would have multiple volume-per-stroke settings providing variation to the amount of the composition being applied. The preferred application is to distribute the fine mist evenly over the fabric surface. On heavy fabrics apply additional composition.

The present invention also brings to the art the low-level energy input of gently brushing the consumer's free hand across the fabric or gently shaking the clothes hangar upon which the treated garment rests soon after the composition is applied to enhance de-wrinkling. Allow a few seconds for the composition to penetrate the fabric weave and go to work to remove wrinkles. Over a short time and/or enhanced by any acceptable slight manual manipulation of the fabric, wrinkles are gone. The user may hand form a crease in a fabric or garment to achieve a different desired result.

The present composition, delivered by pre-compression trigger sprayer sprays only enough of the composition to the fabric to provide effective wrinkle reduction and relaxation, much like steaming. And, one may apply additional spray shots of the present composition to heavy fabrics and not significantly increase the risk of spotting. Then, over a short time and/or enhanced by a slight manipulation of the fabric, wrinkles are gone.

The preferred composition includes a surfactant or surfactants in much smaller concentrations compared to the prior art. Surfactants when added to process quality softened, filtered water help reduce surface tension which greatly enhances the introduction of the misted composition into the fabric medium. The preferred composition includes linear alcohol ethoxylate surfactants that are extremely effective wetting agents at very low concentrations. Linear alcohol ethoxylates are readily biodegradable. Wetting of the fibers in the weave is accomplished with a minimum amount of water and, a non-ionic surfactant comprised of linear alcohol ethoxylates in a range from 8 to 15 carbons, and preferably 11 carbon atoms, and ranging in percent by volume allowable from between 5.0 and 0.005 percent by volume, preferably from between 0.008 and 0.12 percent by volume, thus ensuring: 1) that the fabric will de-wrinkle; and, 2) that the fabric will also dry quickly.

The preferred surfactant is BIO-SOFT N1-7, a clear, water soluble slightly hazy non-ionic linear alcohol ethoxylate (@ 25 degrees (C.)) based on a synthetic C11 alcohol base having the chemical formula $C_{11}H_{23}(OCH_2CH_2)_7OH$ consisting of alcohols C11ethoxylated, actives 99.5%, pour point of 13 degrees (C.), pH 1% aqueous 6.0-7.5, boiling point 100 degrees (C.), flash point, PMCC greater than 201 degrees (F.), as such example is produced by Stepan Canada Inc., Longford Mills and distributed by Van Waters & Rogers Inc., a Royal Vopak Company, Kirkland, Wash.

While the above surfactant is preferred, in some circumstances it may desirable to use other non-ionic surfactants, such as those branded TRITON X-100, originally developed by Rohm and Haas, but now owned by Union Carbide corporation, Danbury, Conn., produced as X-100 and TRITON X-100, an octylphenol ethylene oxide condensate; Octoxynol-9. TRITON X-100 is a stable material having a specific gravity of 1.065@25 (C.), average molecular weight of 625, giving effective molarity=1.7M. The preferred surfactant is a non-ionic to maintain a neutral charge. In addition, super-wetters such as BIO-SOFT, N-SERIES, in very low, but effective concentrations virtually eliminates residue.

Linear alcohol ethoxylates are super-wetters that when subjected to the Draves Wetting Test at concentrations by volume at our preferred concentration, came in with an average wetting out time of only ten seconds. This state-of-the-art minimalist approach ensures the fastest wetting-out times and the effectiveness of the active ingredients ensures the lowest residue possible. Our minimalist approach also ensures the fastest drying times. A 15 cubic centimeter sample of the present preferred composition was air dried under household conditions on a clear glass plate. One strained to see the minute amount of resulting residue.

The preferred linear alcohol ethoxylates are so effective at reducing surface tension, with only minute amounts of surfactant very fine droplet/particles of the present composition can be introduced uniformly, effectively to the fibers of a fabric or garment—no more/no less than is necessary to effectively de-wrinkle in the home, or in a commercial setting.

In the prior art alcohol is often characterized as a fellow lubricant, something that imparts a lubricating coating to fabric fibers. In this composition, alcohol is recognized to: 1) reduce the viscosity of the composition and lubricate fibers in the fabric weave; and, 2) facilitate drying of the fabric weave. A reduction in viscosity results because alcohol lowers the vapor pressure of the composition. Lowering viscosity enhances wetting of fibers because it promotes small droplet formation as the composition leaves the pre-compression sprayer. Lower viscosity also promotes an ease of penetration of, and wetting and lubricating the fibers. Equally important however, is the role of alcohol in drying the fabric, very quickly after the composition is applied. Drying takes place as alcohol's evaporation lowers the vapor pressure at the fabric surface. Acceptable low molecular weight, water-soluble alcohols/solvents include ethanol, propanol, and isopropanol and mixtures thereof. n-Propanol is preferred, but may be admixed with other similar low molecular weight alcohols. The preferred alcohol is pure n-Propanol, CH3(CH2)2 OH, ethyl carbinol, CAS No. 71-23-8 having a molecular weight of 60.1, and the preferred embodiment contains n-Propanol, alone and not in combination with any other alcohol. n-Propanol is available from a number of manufacturers and has the characteristics of 73 degree (F.) flash point, is infinitely soluble in water, has a specific gravity of 0.804, a boiling point of 207 degrees (F.), vapor density (Air=1) 2.07, and a vapor pressure of 21@77 (F.). The alcohol in the composition may range from 6 to 18 percent by volume, it has preferably ten percent (10%) by volume n-Propanol. n-Propanol dries quickly and does so in harmony with our preferred fragrances.

Testing of the present composition against Trinh and Targoz has demonstrated the fastest drying times heretofore claimed in the art. Comparative tests between the present composition and Trinh et al clearly demonstrate a drying rate that is less than one half the drying time of Trinh et al. The present composition provides a practical drying period from application to use that allows the user to wear the garment shortly after de-wrinkling, or at household speeds. Tests have demonstrated drying times of thirty to sixty seconds for fine fabrics and from less than one minute to several minutes drying times for heavier fabrics. Clearly, the present composition delivers the most practical drying times in the art.

The preferred compositions introduce another novel and practical feature to the art. That is, purposefully lowering the pH to protect against dye bleeding. One acid, or a combination of acids are acceptable for this purpose, at effective levels that lower the pH of the composition to protect against dye bleeding. Lowering pH may be accomplished by adding one or more acids selected from a group consisting of, (i) glycolic (ii) citric (iii) glacial acetic (iv) tartaric (v) oaxalic (vi) sulfamic (vii) sulfuric, and (viii) phosphoric. The acid in the preferred embodiment of the composition is glycolic acid, in such concentrations to lower the pH of the composition to ensure color-safeness. Glycolic acid is readily bio-degradable and distributed by a number of manufacturers. Glycolic acid, HO(CH2)COOH, CAS No. 79-14-1, hydroxy acetic acid, has a pH of 0.1@25 degrees (C.), boiling point of 234 degrees (F.), is miscible in water, a pH of 0.1@77 degrees (F.), a vapor pressure equal to water, and a density of 1.25 g/cc @79 degrees (F.), manufactured/distributed by Dupont, Wilmington, Del. By lowering the pH, the composition can be applied on all types of casual to fine fabrics without concerns about dye bleeding, without causing fugitive dyes to run, without affecting natural, native, or vintage dyes, and without promoting cellulosic browning. The composition will also de-wrinkle and prevent changes in the color of commercial fabrics.

Neutral or higher pH will foster or promote bleeding of fugitive dyes, natural dyes, native dyes and vintage dyes, as well as promote cellulosic browning. The preferred composition is purposefully buffered to a pH that protects fugitive dyes, natural and native dyes, and vintage dyes. This adjustment of pH provides a novel, practical, safety factor in that the composition now actively protects even the most sensitive colors and delicate fabrics by stabilizing any sensitive dyes present in the fabric. Acidic solutions, rinses or souring agents used on such delicate, natural or vintage fabrics eliminate or mitigate against the potential for ill-effects during cleaning. Lowering the pH of the present composition applies these well-known principals to this field.

Another novel and practical feature of the invention is the addition of an optional malodor-eliminating compound or compounds to the composition that keeps fabrics fresh longer, or refresh malodorous garments by eliminating, or coupling with, odorous compounds to deodorize them. These carefully constructed semi-rigid, concave molecular structures; complexes that synergistically combine numerous active ingredients into a proven safe and effective deodorizer, that chemically modifies malodors, are present in a percent by volume ranging between 5.0 and 0.001, and preferably present in a percent by volume of 0.10 to keep fabrics smelling fresh longer, or to refresh malodorous garments. The preferred odor-eliminating compound used according to the invention is ORDENONE a brand of Belle-Aire Fragrances, Inc., Mundelein, Ill. ORDENONE is described by Belle-Aire as a water-based compound or compounds of carefully constructed semi-rigid, concave molecular structures, complexes that synergistically combine numerous active ingredients into a proven safe and effective deodorizer fragrance that chemically modify malodorous compounds. ORDENONE is stable, with a specific gravity of 1.06 (H2O=1), 100% percent soluble in water, contains 5.7% VOCs, a boiling point of 81 degrees (C.), a specific gravity of 1.04@25 degrees (C.), and flash point of 103 degrees (F.). ORDENONE is stable at low pH. Because of the effectiveness of the state-of-the-art compounds used, odor-control can be accomplished by minute additions of ORDENONE without significantly increasing residues.

Adding an optional, quaternary ammonium compound, preferably benzethonium chloride, a quaternary ammonium compound that dries to a crystalline solid form, may reduce static cling without significantly increasing residues, at the same time eliminating the tacky residues found in the prior art. HYAMINE, Diisobutylphenoxyethyldimethylbenzylammonium chloride monohydrate is preferred and is a product of Lonza Inc., Fair Lawn, N.J., added at a percent by volume ranging between 2.0 and 0.001 to mitigate against static cling without imparting tacky residues. HYAMINE is a stable anti-microbial quaternary ammonium compound with a specific gravity of 27.5 lb./ft. 3 (H2O=1), soluble in water, chemical formula C(24-27)H42ClNH2O and a molecular weight of approximately 466. The product is stable at low pH.

Fragrances are added to the compositions to help modify the alcohol scent, to help identify the product, and to provide a pleasant identifying experience when a consumer uses the composition.

The composition remains stable under any routine consumer environmental condition without additives or preservatives.

The best method for preparing the preferred composition is in an open vessel made of glass, plastic or other inert material, however, the final embodiment should be transferred into an enclosed vessel after preparation. Ambient pressures apply throughout the manufacturing process. Warm softened, filtered process quality water is added in stages, with twenty to thirty percent added into the vessel first. To this is added room temperature premixed surfactant in a separate container and diluted with warm process water. Add this to the open vessel. Rinse the surfactant-mixing container repeatedly with warm process water and add the rinse to the mixture. Throughout, the combination is gently mixed. Alcohol or alcohols totaling ten percent of the volume and additional warm water may be added. Malodor-eliminating compounds are added in quantities sufficient to perform. pH is tested and a sufficient amount of acid is added at room temperature to the mixture to lower the pH to an effective level. A water-soluble fragrance is added. The addition of glycolic acid serves as the composition's own preservative, making the addition of a preservative or preservatives unnecessary.

The composition is tested on sample fabrics. PH is tested. The composition demonstrates a remarkable ability to remove or reduce wrinkles in natural fabrics and in synthetic fabrics. The composition according to the invention produced results that in most instances are remarkable. For example, un-wearable silks, crumpled by hand with violent force, became wrinkle free and ready to wear. Cottons and denims performed equally as well. Heavier fabrics, with more of the composition applied due to the increased fabric weight, performed well although drying times were extended slightly. And, one may effectively apply additional spray shots of the present composition to heavy fabrics and not significantly increase the risk of spotting or dye bleeding. Sensitive natural or vintage dyed garments were crumpled and treated and de-wrinkle with no ill effects or dye bleeding.

The present composition is color-safe, fast drying, environmentally friendly and safe for use in a commercial setting. Adding an optional malodor-eliminating compound to the composition keeps commercial fabrics smelling fresh longer and/or refreshes malodorous garments by eliminating malodorous compounds. Adding an optional quaternary ammonium compound to the composition mitigates against static cling.

The invention claimed is:

1. A color-safe fabric wrinkle removing and refreshing composition to be applied on casual to fine clothing and fabrics, comprised of: a) water in a range of 82% to 94% by volume; b) surfactant in a range of 0.005% to 5% by volume; c) alcohol in a range of 6% to 18% by volume; d) acid in an amount sufficient to lower and maintain the pH to within a range that ensures the composition is color-safe; and, e) a malodor-eliminating compound having the form of a semi-rigid, concave molecular structure complex that synergistically combines numerous active ingredients for chemically modifying malodorous compounds, in a range of 0.001% to 5%.

2. The composition of claim 1, wherein said water is process quality softened, filtered water.

3. The composition of claim 1, wherein said surfactant is a non-ionic surfactant.

4. The composition of claim 1, wherein said alcohol is selected from the group consisting of ethanol, propanol, and isopropanol.

5. The composition of claim 1, wherein the acid is selected from the group consisting of (i) glycolic acid, (ii) citric acid, (iii) glacial acetic acid, (iv) tartaric acid, (v) oaxalic acid, (vi) sulfamic acid, (vii) sulfuric acid, and, (vii) phosphoric acid.

6. The composition of claim 1, wherein said surfactant is a linear alcohol ethoxylate surfactant.

7. The composition of claim 6, wherein said nonionic linear alcohol ethoxylate surfactant has from 8 to 15 carbon atoms.

8. The composition of claim 1, further comprising a quaternary ammonium compound that dries to a non-tacky solid, in a range of 0.001% to 2% ft.

* * * * *